US006986380B1

(12) United States Patent
Rice et al.

(10) Patent No.: US 6,986,380 B1
(45) Date of Patent: Jan. 17, 2006

(54) VEHICLE WHEEL MOLD HAVING A SCREENLESS GATE

(75) Inventors: Steve Rice, Warren, IN (US); Tim O'Banion, Marion, IN (US)

(73) Assignee: Hayes Lemmerz International, Inc., Northville, MI (US)

( * ) Notice: Subject to any disclaimer, the term of this patent is extended or adjusted under 35 U.S.C. 154(b) by 0 days.

(21) Appl. No.: 10/909,068

(22) Filed: Jul. 30, 2004

(51) Int. Cl.
*B22C 9/08* (2006.01)
*B22D 18/04* (2006.01)

(52) U.S. Cl. ..... 164/306; 164/134; 164/358

(58) Field of Classification Search ..... 164/134, 164/358, 113, 119, 303–318

See application file for complete search history.

(56) References Cited

U.S. PATENT DOCUMENTS

| | | | |
|---|---|---|---|
| 3,981,352 | A | 9/1976 | Nurminen et al. |
| 4,928,746 | A | 5/1990 | Butler et al. |
| 4,961,460 | A | 10/1990 | Butler et al. |
| 5,033,531 | A | 7/1991 | Fisher et al. |
| 5,425,410 | A | 6/1995 | Reynolds |
| 5,556,592 | A | 9/1996 | Hitchings |
| 5,603,373 | A | 2/1997 | Daussan et al. |
| 5,676,731 | A | 10/1997 | Hitchings |
| 5,690,161 | A | 11/1997 | Daussan et al. |
| 5,896,912 | A | 4/1999 | Monroe et al. |
| 6,289,969 | B1 | 9/2001 | Outten et al. |

*Primary Examiner*—Kuang Y. Lin
(74) *Attorney, Agent, or Firm*—MacMillan, Sobanski & Todd, LLC

(57) ABSTRACT

Intervening fingers mounted within a mold gate cavity extend across a portion of the gate cavity and cooperate with one another to slow the flow of molten metal into the mold cavity and thereby reduce flow turbulence.

17 Claims, 6 Drawing Sheets

VEHICLE WHEEL MOLD HAVING A SCREENLESS GATE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISC APPENDIX

Not Applicable

BACKGROUND OF THE INVENTION

This invention relates in general to molds for casting vehicle wheels and in particular to a vehicle wheel mold having a screenless gate.

Vehicle wheels have a circular wheel disc attached to an annular wheel rim. The wheel disc includes a central wheel hub having a pilot hole and plurality of wheel mounting holes formed therethrough. A plurality of equally circumferentially spaced spokes typically support the wheel hub within the wheel rim. The wheel rim is adapted to support a pneumatic tire.

In the past, vehicle wheels typically have been formed entirely from steel. However, wheels formed from light weight metals, such as aluminum, magnesium and titanium or alloys thereof, are becoming increasingly popular. In addition to weighing less than conventional all-steel wheels, such light weight wheels can be manufactured having a pleasing esthetic shape. Weight savings also can be achieved by attaching a wheel disc formed from a light weight metal alloy to a steel wheel rim.

Light weight wheels are typically formed by forging or casting operations. During a forging operation, a heated billet of the light weight metal alloy is squeezed by very high pressure between successive sets of dies until the final shape of the wheel is formed. During a casting operation, molten metal is inserted into a cavity formed in a multi-piece wheel mold. After the metal cools sufficiently to solidify, the mold is opened and a rough wheel casting is removed. The wheel casting is then machined to a final shape. Machining can include turning the outside and inside surfaces of the wheel rim, facing the inboard and outboard wheel disc surfaces and drilling the center pilot hole and the mounting holes through the wheel hub.

Conventional casting operations include numerous processes, such as die casting, low pressure injection casting and gravity casting. All the conventional casting operations typically utilize a wheel mold formed from a number of segments. The wheel mold defines a mold cavity which includes a rim cavity for casting the wheel rim and a disc cavity for casting the wheel disc.

For high volume production of castings, such as vehicle wheels, highly automated gravity casting processes are frequently used that typically use a casting machine having a plurality of molds mounted upon a moving structure, such as a rotatable carousel. Each mold is indexed past a refractory furnace containing a pool of molten metal. A charge of molten metal is poured into a gate formed in the mold which communicates with the mold cavity. Gravity causes the metal to flow from the gate into the mold cavity, filling the rim and disc cavities. The mold and the molten metal cool as the casting machine indexes the other molds to the refractory furnace for charging with molten metal. After a sufficient cooling time has elapsed, the mold is opened and the wheel casting removed for machining to a final shape. The mold is then closed and again indexed to the refractory furnace to be refilled with molten metal.

Referring now to the drawings, a sectional view of a typical known gravity casting wheel mold 10 is shown in FIG. 1. The mold 10 is formed from a high temperature resistant metal, such as a steel alloy. The mold 10 includes a base segment 12 which can include a plurality of subsegments. The mold 10 further includes a pair of movable side segments, one of which is shown in FIG. 1 and labeled 18. Each of the side segments is supported by the base segment 12 and can include a plurality of subsegments. The side segments can be extended to a closed position or retracted to an open position by a conventional mechanism which, for clarity, is not shown in FIG. 1. The side segments carry a pair of gate members, one of which is shown in FIG. 1 and labeled 20. The gate member 20 extends from the right side of the side segment 18 in FIG. 1. The gate members co-operate to form a gate 21 that receives molten metal for casting the wheel. The gate 21 includes a tappered inlet chamber 22 into which the molten metal is poured. The inlet chamber 22 communicates through a gate passageway 25 with an intermediate chamber 26 formed within the gate member 20. A narrow axial opening 27 is formed through the inner wall of the side member 18, the purpose for which will be explained below.

The mold 10 also includes a filter, or screen, 28, which is formed from a porous material, which is typically a ceramic, such as, for example, alumina foam, zirconia, silicon carbide or mica, is disposed across the base of the inlet chamber 22. Alternately, the filter can comprise a fiberglass screen (not shown). As shown in FIG. 1, the filter 28 is received in the bottom of the inlet chamber 21 and supported by a shoulder 29 formed therein.

The side segments receive an axially movable top segment 30. The top segment 30 can be extended to a closed position and retracted to an open position by a conventional mechanism which, for clarity, is not shown in FIG. 1. Similar to the other segments, the top segment 30 can include a plurality of subsegments. A ball riser segment 32 having an inverted cup shape is mounted in the center of the top segment 30. The ball riser segment 32 defines an interior chamber that is referred to as a ball riser cavity 34 in the following. A vent opening 36 is formed through the top of the ball riser segment 32.

When the top and side segments are extended to their closed positions, the mold 10 is closed and the top segment 30 cooperates with the base segment 12 and the side segments to define a mold cavity 40 for casting a vehicle wheel. The mold cavity 40, as shown in FIG. 1, includes a generally circular disc cavity 42 for casting the wheel disc and an annular rim cavity 44 for casting the wheel rim. The disc cavity 42 communicates with the ball riser cavity 34 while the rim cavity 44 terminates in an annular rim riser cavity 46. As described above, the axial opening 27 in the side segment 18 provides communication between the gate intermediate chamber 26 and the mold cavity 40.

The operation of the apparatus 10 will now be described. The side and top segments are moved to their extended positions to close the mold 10. Molten metal is poured into the gate 21. Gravity causes the molten metal to flow through the filter, or screen, 28 and the gate passageway 25 and into the intermediate chamber 26. The filter 28 removes oxides and other impurities from the molten metal. The filter 28 also reduces turbulence in the molten metal as the mold cavity 40 is filled, reducing oxidation of the molten metal. From the intermediate chamber 26, molten metal flows through the axial opening 27 and into the mold cavity 40. The molten metal flows across the disc cavity 42 and into the ball riser cavity 34. Similarly, molten metal fills the rim cavity 46 and enters the rim riser cavity 46. Pouring continues until the gate inlet chamber 22 is filled with molten metal. Contraction occurs as the molten metal solidifies, and molten metal flows from the rim and ball riser cavities 34 and 46 to fill any voids caused by the shrinkage. After the casting has cooled sufficiently, the top and side segments are retracted from the base segment 12, allowing removal of the casting.

During the casting operation, the filter 28 solidifies with the metal of the sprue formed in the gate 22. After each casting operation, the filter 28 removed with the wheel casting and discarded with when the sprue is cut from the casting. Accordingly, it is necessary to insert a new filter 28 into the gate before using the mold to cast another wheel. The replacement of the filter 28 is a time consuming operation and thus adds to the cost of manufacturing the wheel Additionally, the cost of the replacement screens further increases the total wheel manufacturing costs. Therefore, it would be desirable to provide an alternate reusable device in place of the screen.

BRIEF SUMMARY OF THE INVENTION

This invention relates to a mold for casting a vehicle wheel that has a screenless gate.

The present invention contemplates a mold for casting a vehicle wheel that includes a base segment, a top segment movable between a retracted position and an extended position and first and second side segments movable between retracted positions and extended positions. The base, top and side segments cooperate when extended to define a mold cavity with the first and second side segments further cooperating to define a gate cavity. The gate cavity is adapted to receive molten metal and communicates with the mold cavity. The invention further contemplates a pair of matrices of fingers with each of the matrices mounted within the gate cavity portion of one of said side segments. The matrices extend in a generally orthogonal direction from the surface of the side members portion and co-operate with one another when the side segments are extended to restrain the flow of molten metal through the gate cavity. The fingers may be either mounted directed upon the mold side segments or upon removable support members that are attached to the mold side segments.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
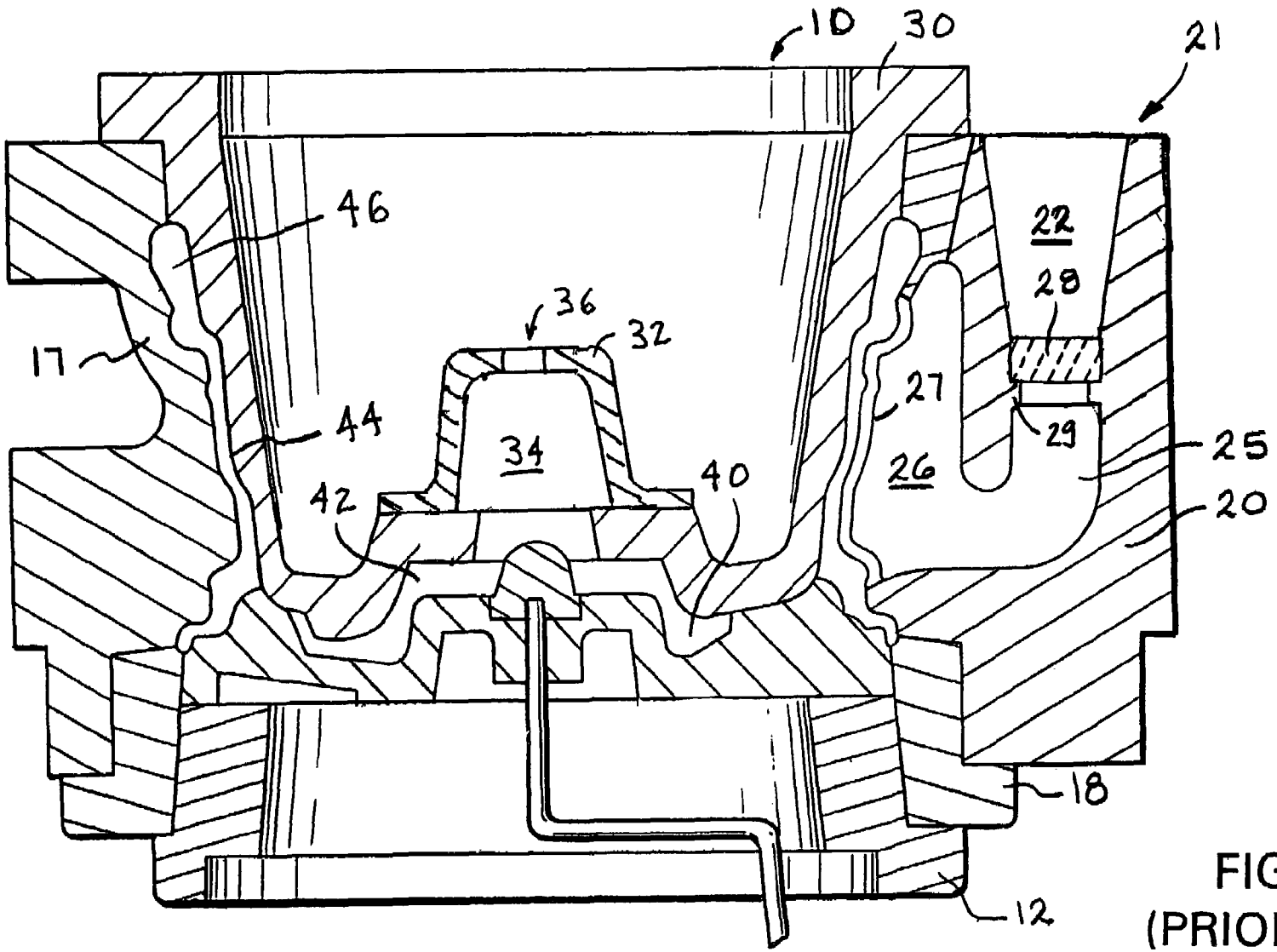
FIG. 1 (PRIOR ART)
FIG. 1 is a sectional view of prior art gravity casting wheel mold.
Figure 2:
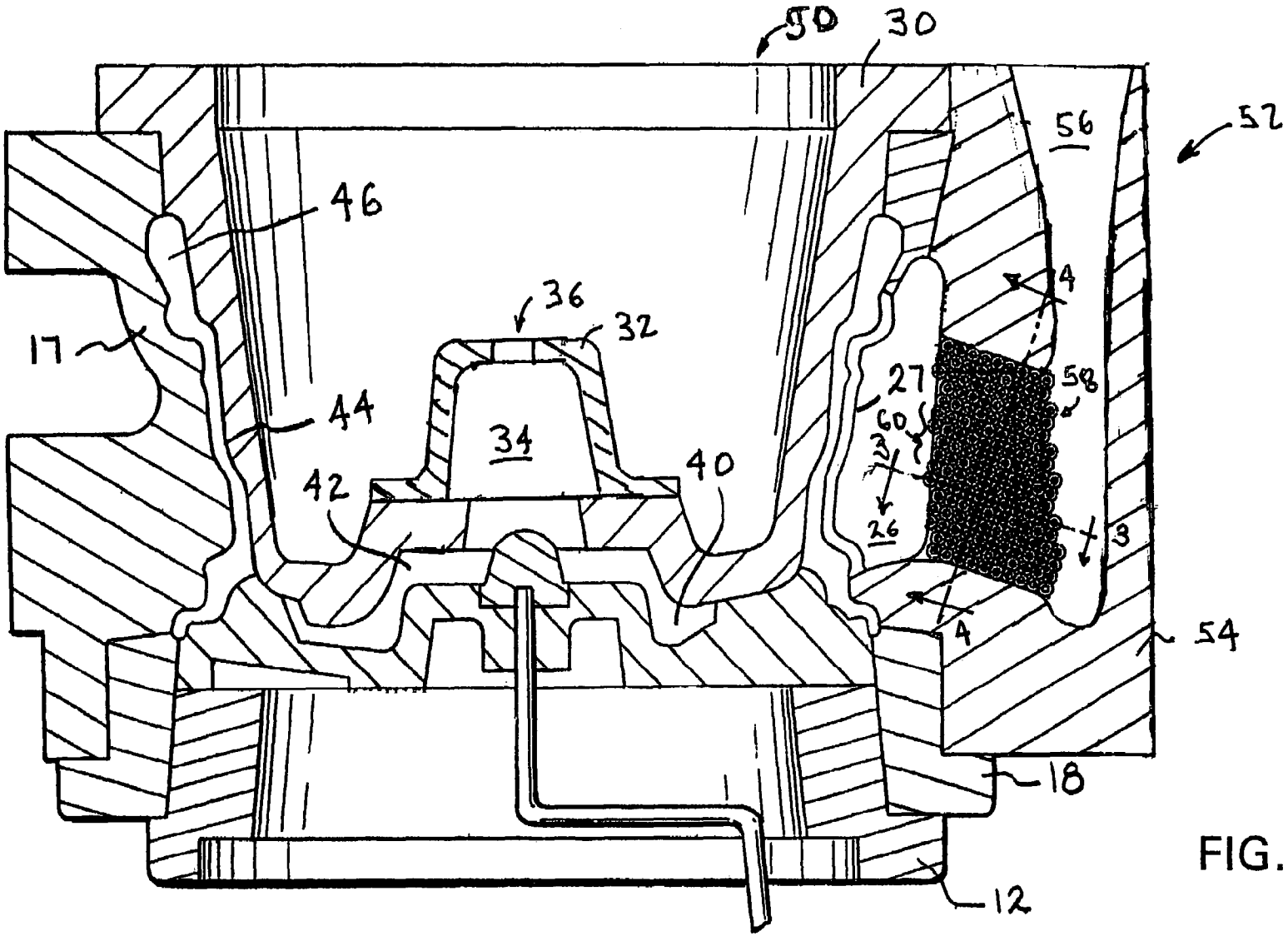
FIG. 2 is a sectional view of a gravity casting wheel mold according to the present invention.

Referring again to the drawings, there is illustrated in FIG. 2 an improved gravity casting vehicle wheel mold 50 that includes a screenless gate 52 in accordance with the invention. Components shown in FIG. 2 that are similar to components shown in FIG. 1 have the same numerical identifiers. Thus, the mold includes a base segment 12 that supports a pair of side segments, one of which is shown in FIG. 2 and labeled 18, and a top segment 30. The top segment carries a ball riser segment 32. Upon closing the mold segments, a mold cavity 40 is formed for casting a one piece vehicle wheel.

The gate 52 is formed from a pair of gate members 54 and 55, one of which is shown in FIG. 2. The gate members 54 and 55 are mounted upon corresponding mold side segments with gate member 54 shown as mounted upon side segment 18 in FIG. 2. The gate members close with the mold side segments to form the gate 52. While the figures illustrate separate gate members mounted upon mold side segments, it will be appreciated that the invention also contemplates forming the gate 52 in an extended portion of the mold side segments (not shown). Similar to the prior art mold described above, the gate 52 includes a tapered inlet chamber 56 formed in the gate members that receives molten metal. The tapered inlet chamber 56 communicates with a generally rectangular filter chamber 58. The filter chamber 58 communicates with the intermediate chamber 26 that, in turn, communicates with the mold cavity 40 through the axial opening 27 formed in the side segments.

Figure 3:
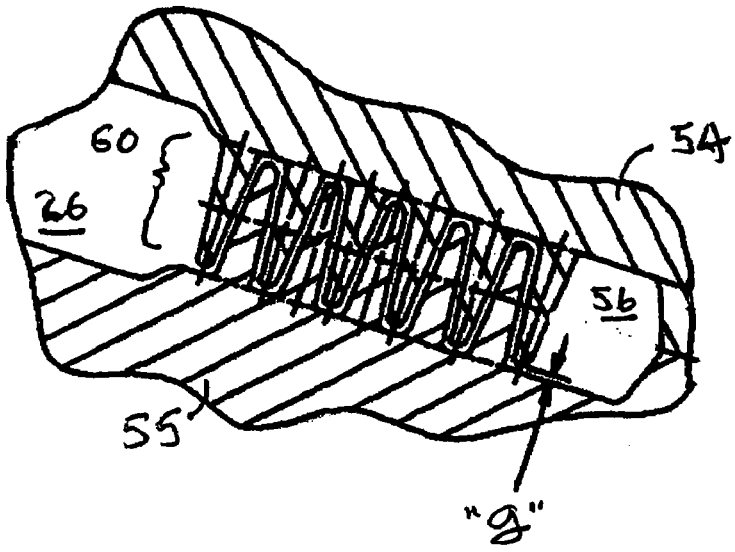
FIG. 3 is an enlarged fragmentary sectional view taken along the line 3—3 in FIG. 2.
Figure 4:
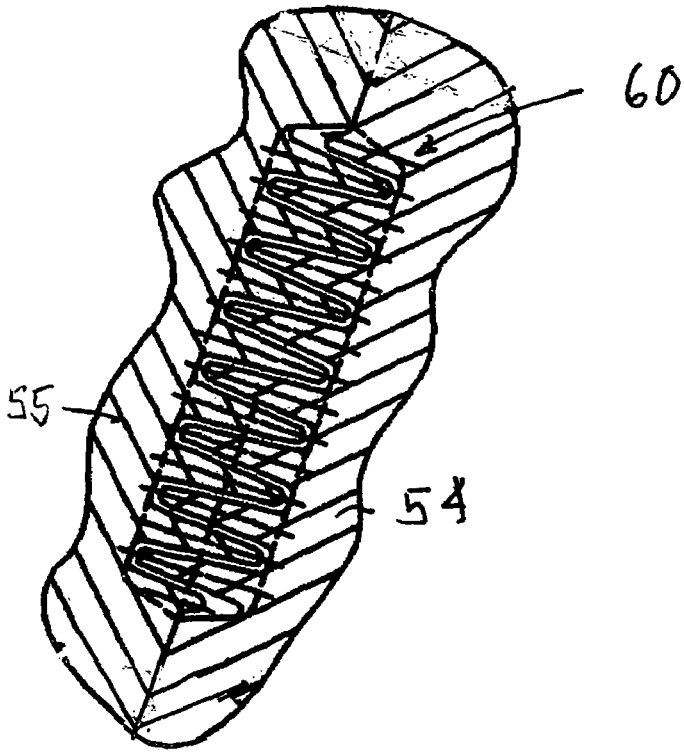
FIG. 4 is an enlarged fragmentary sectional view taken along the line 4—4 in FIG. 2.

A plurality of generally tapered, or conical, fingers 60 having rounded ends extend orthogonally into the filter chamber 58 from both gate members 54 and 55 and are arranged to form a pair of filtering matrixes. As best seen in FIGS. 3 and 4, the individual fingers 60 are tapered sufficiently that each of the fingers 60 of one of the matrixes extending from the sidewall of one of the gate members intervenes between two corresponding fingers 60 of the other matrix extending from the sidewall of the other gate member. In the preferred embodiment, the diameter of the fingers 60 at the base is 0.274 inches and the spacing between the centerlines of adjacent fingers is 0.494 inches; however, the invention also may be practiced with fingers having greater or lesser base diameters and spacing. The height of the fingers 60 is a function of the width of the filter chamber 58. As also shown in FIGS. 3 and 4, the fingers on each of the gate members 54 and 55 extend sufficiently between the corresponding fingers on the opposite gate member such that only a narrow gap "g" exists between sets of intervening fingers 60. In the preferred embodiment, the gap "g" between the fingers 60 is within the range of 0.060 to 0.080 inches; however, the invention also may be practiced with smaller or larger gaps. Thus, the matrixes of fingers 60 extending from the gate members 54 and 55 co-operate within the filter chamber 58 to form a web or sieve across the filter chamber 58.

As shown in FIG. 2, in the preferred embodiment, the fingers 60 are spaced in parallel lines that are in a slightly upward direction from right to left in the figure; however, the fingers may also be staggered (not shown) in a non-parallel orientation and oriented in a different direction than shown in FIG. 2. Also, as shown in FIGS. 3 and 4, the fingers 60 are formed continuously, or integrally, with the gate members 54 and 55 and are thus comprised of the same material, which, in the preferred embodiment, is H13 alloy steel. Alternately, the individual fingers 60 may be formed separately and attached to the surface of the filter chamber portion of the gate members 54 and 55 by a conventional method, such as welding or use of threaded fasteners. Also, in the preferred embodiment, the fingers are hardened to HRC 47±2 and then nitrated for strength and durability.

The operation of the improved screenless mold 50 will now be described. The side and top segments are moved to their extended positions to close the mold 50. As the side members are extended, the gate members 54 and 55 co-operate to form the gate 52. Molten metal is poured into the gate inlet chamber 56. Gravity causes the molten metal to flow between the fingers 60 in the filter chamber 58 and into the intermediate chamber 26. The high velocity of the molten metal in the gate inlet chamber 56 is slowed by the metal impinging upon the fingers 60 and the flow is broken into a number of smaller, low velocity streams as it enters the intermediate chamber 26. Thus, the fingers 60 co-operate with one another to reduce turbulence in the molten metal as the mold cavity 40 is filled, reducing oxidation of the molten metal. Depending upon the size of the gap g, the fingers 60 also may co-operate to entrap and thus remove oxides and other impurities from the molten metal. From the intermediate chamber 26, molten metal flows through the axial opening 27 and into the mold cavity 40. The molten metal flows across the disc cavity 42 and into the ball riser cavity 34. Similarly, molten metal fills the rim cavity 46 and enters the rim riser cavity 46. Pouring continues until the gate inlet chamber 22 is filled with molten metal. Contraction occurs as the molten metal solidifies, and molten metal flows from the rim and ball riser cavities 34 and 46 to fill any voids caused by the shrinkage. After the casting has cooled sufficiently, the top and side segments are retracted from the base segment 12, allowing removal of the casting.

Upon opening the mold 50, the movement of the gate members 54 and 55 withdraws the fingers 60 in the filter chamber 58 from the casting gate sprue. The portion of the gate sprue formed in the filter chamber 58 will include a plurality of conical recesses formed therein by the fingers 60. However, the fingers 60 remain upon the gate members 54 and 55 and are available for the next casting cycle. Thus, the present invention contemplates replacing the prior art filter, or screen, 28 mounted in the base of the gate inlet chamber 22, as shown in FIG. 1, with the plurality of reusable intertwined generally conical fingers 60 extending across a portion of the gate passage. Because the fingers 60 are reusable, the inventors expect a significant reduction in costs while eliminating the mold down time required for insertion of a new screen after every casting operation. The elimination of screen replacement downtime provides a corresponding increase in production rate.

Figure 5:
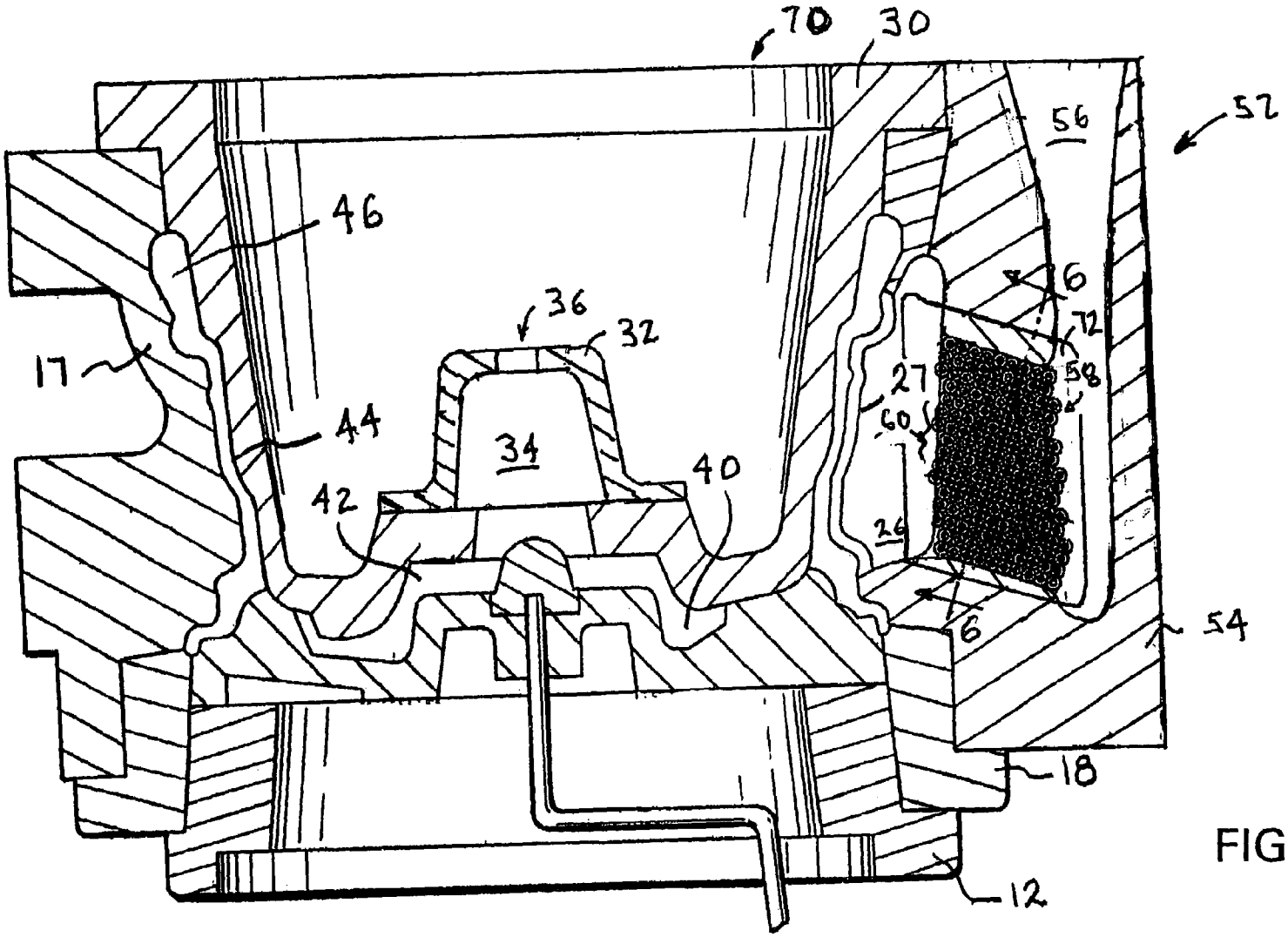
FIG. 5 is a sectional view of an alternate embodiment of the mold shown in FIG. 2.
Figure 6:
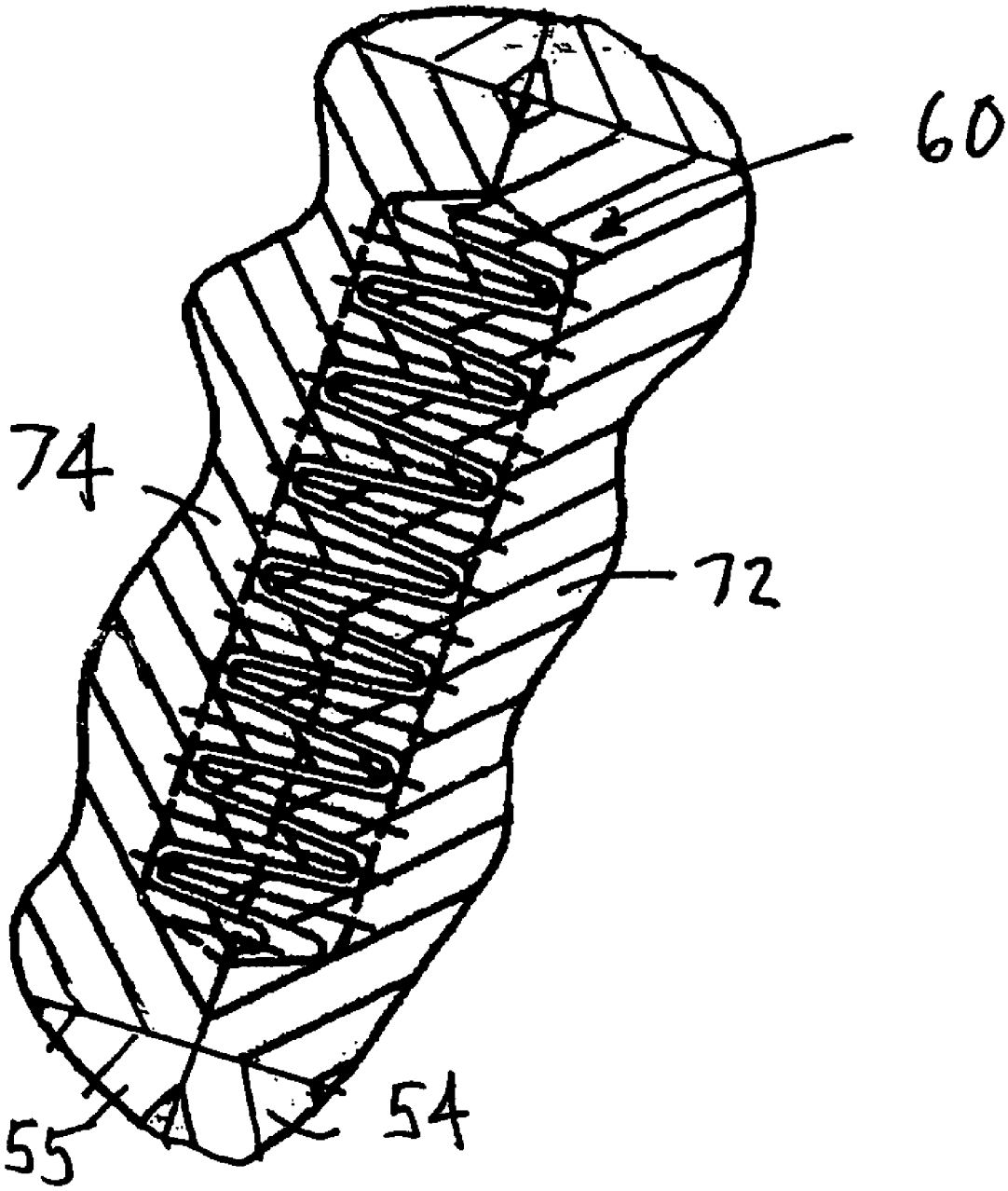
FIG. 6 is an enlarged fragmentary sectional view taken along the line 6—6 in FIG. 5.

The inventors have found that the molten metal passing between the fingers and the cyclical heating and cooling as castings are formed may cause undue erosion and cracking of the fingers 60. Therefore, the inventors have found that it is necessary to periodically replace the fingers 60. Accordingly, an alternate embodiment 70 of the invention is shown in FIGS. 5 and 6 that enhances replacement of the fingers 60. As before, components shown in FIGS. 5 and 6 that are similar to components shown in the preceding figures have the same numerical identifiers. In the alternate embodiment 70, each matrix of fingers 60 is mounted upon one of a pair of removable support members 72 and 74, one of which is shown in FIG. 5. The support members 72 and 74 are received in recesses or openings formed in the gate members 54 and 55 and removably attached thereto. The support members 72 and 74 have shapes that match the filter chamber 58. Thus, in FIG. 5, the support members 72 and 74 generally have a shape of a parallelogram; however, it will be appreciated that the support members also may be formed having different shapes, such as, for example, a square or rectangle.

The support members 72 and 74 and the fingers 60 may be formed from the same or a different material than the gate members 54 and 55. In the preferred embodiment, the support members 72 and 74 and the fingers 60 are formed from Anviloy which the inventors have found to more durable that H13 alloy steel; however, other materials also may used. Also, in the preferred embodiment, the fingers are hardened to HRC 47±2 and then nitrated for strength and durability. As before, the fingers 60 may be formed continuously, or integrally, with the support members 72 and 74 or the individual fingers 60 may be formed separately and attached to the surface of the support members 72 and 74 by a conventional method, such as welding or threaded fasteners. By using a different material for the fingers 60, the inventors have found that more cycles may be completed before replacing the fingers. Additionally, by mounting the fingers 60 upon removeable support members 72 and 74, replacement time is greatly reduced.

Figure 7:
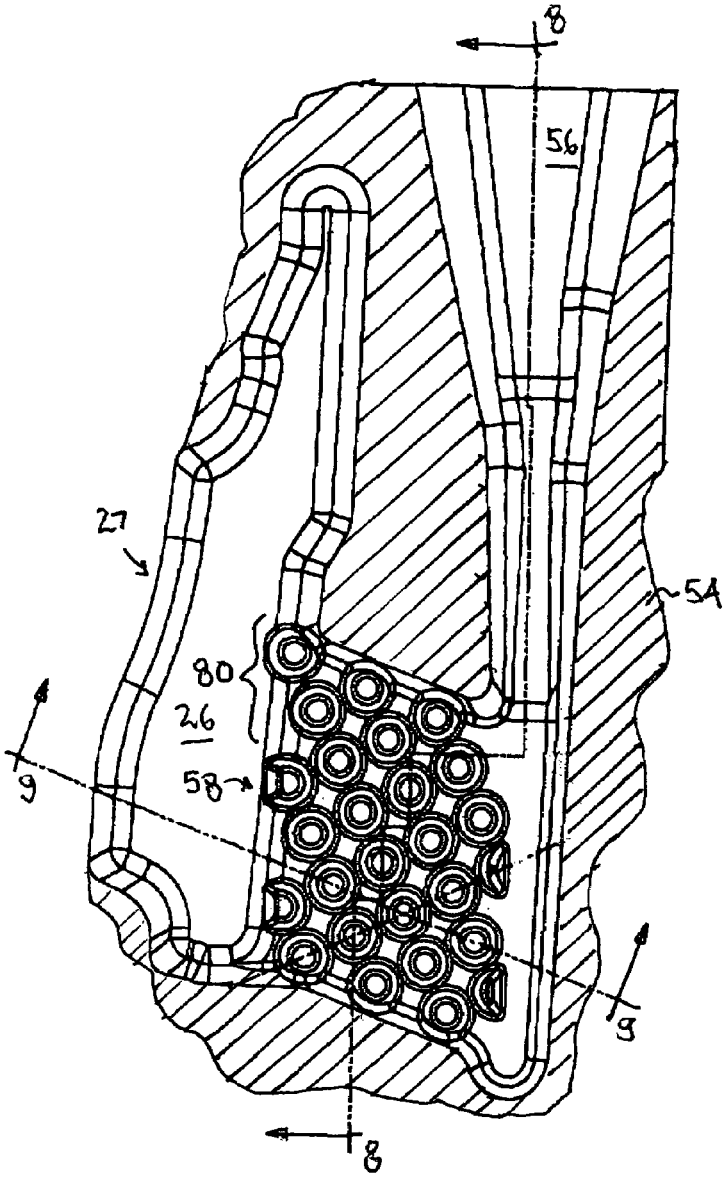
FIG. 7 is an enlarged fragmentary sectional view of a portion of the mold shown in FIG. 2 that includes another alternate embodiment of the invention.
Figure 8:
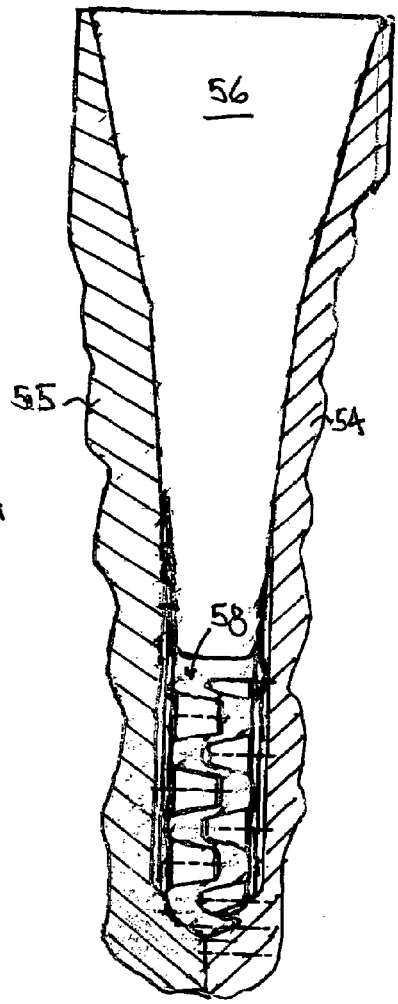
FIG. 8 is a fragmentary sectional view taken along the line 8—8 in FIG. 7.
Figure 9:
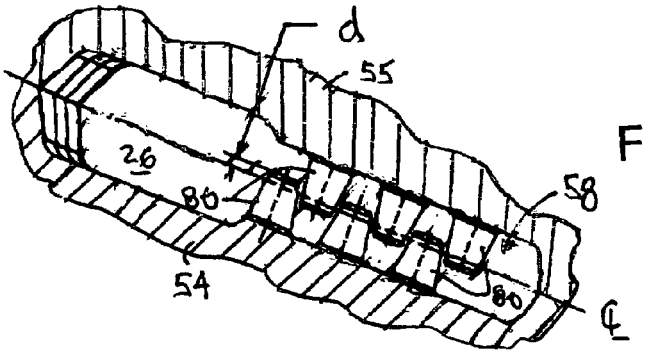
FIG. 9 is a fragmentary sectional view taken along the line 9—9 in FIG. 7.

Another alternate embodiment of the screenless gate is illustrated in FIGS. 7 through 9 where components that are similar to components shown in the preceding Figs. again have the same numerical identifiers. As before, a plurality of fingers 80 extend orthogonally into the filter chamber 58 from both gate members 54 and 55 and are arranged to form a pair of filtering matrixes. However, the fingers 80 are formed as truncated cones having a greater base diameter than the fingers 60 shown in the previous Figs. In the preferred embodiment, the diameter of the fingers 80 at the base is 0.582 inches and the spacing between the centerlines of adjacent fingers is 0.660 inches; however, the invention also may be practiced with fingers having greater or lesser base diameters and spacing. The height of the fingers 80 is a function of the width of the filter chamber 58. The ends of the fingers 80 may be either generally flat or have a slightly convex shape. As shown in FIGS. 8 and 9, the individual fingers 80 of one of the matrixes extending from the sidewall of one of the gate members again intervenes between two corresponding fingers 80 of the other matrix extending from the sidewall of the other gate member. However, the fingers do not extend as far toward the opposite side of the filter chamber 58. As best seen in FIG. 8, the end of each finger extends past the center line of the filter chamber 58 by an overlap distance "d". In the preferred embodiment, the overlap distance d is within the range of 0.1000 to 0.1500 inches and preferably about 0.1250 inches; however, the invention may also be practiced with a greater or smaller overlap distance. As before, in the preferred embodiment, the fingers are hardened to HRC 47±2 and then nitrated for strength and durability. The fingers 80 may be formed either with the gate members continuously, or integrally, with the gate members 54 and 55 or separately and attached to the surface of the filter chamber portion of the gate members by a conventional method, such as welding or the use of threaded fasteners. While the matrixes of fingers 80 extending from the gate members 54 and 55 co-operate within the filter chamber 58 to form a web or sieve across the filter chamber 58, they do not extend as far into the resulting casting gate sprue 58 as the fingers 60 described above. Accordingly the withdrawal of the fingers 80 from the casting sprue is enhanced. Additionally, due to the larger base diameters of the fingers 80, fewer fingers are needed to form the matrixes.

The invention also contemplates that the fingers 80 may be mounted upon removable support members that 74 are received in recesses or openings formed in the gate members (not shown) similar to the embodiment illustrated in FIGS. 5 and 6.

While invention has been illustrated and described with the mold 50 shown in FIG. 2 for casting a complete one piece wheel, it will be appreciated that the invention also can be practiced on a mold for gravity casting a wheel component, such as a wheel disc or a partial wheel rim. Furthermore, while the preferred embodiment has been illustrated and described for a gravity casting vehicle wheel mold, it also will be appreciated that the invention also may practiced with molds for other types of casting, such as, for example, low pressure casting. Additionally, the invention also may be practiced with molds utilized to cast objects other than vehicle wheels. Finally, while the fingers 60 forming the matrixes have been illustrated and described as being generally conical in shape, it will be appreciated that the invention also may be practiced with fingers having other shapes than shown or described. For example, a conical finger would have a circular cross sectional shape; however the invention also may be practiced with fingers having oval or elliptical cross sectional shapes.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A mold for casting a vehicle wheel comprising:

a base segment;

a top segment movable between a retracted position and an extended position;

first and second side segments movable between retracted positions and extended positions; said base, top and side segments cooperating when said top and side segments are in said extended positions to define a mold cavity, said first and second side segments further cooperating when in said extended position to define a gate cavity; said gate cavity being adapted to receive molten metal and communicating with said mold cavity; and a pair of matrices of fingers with each of said matrices mounted within the portion of said gate cavity formed in one of said side segments, said matrices of fingers extending in a general orthogonal direction with respect to the flow direction of molten metal and co-operating with one another when said side segments are extended to restrain the flow of molten metal through said sprue.

2. The mold according to claim 1 wherein a filter chamber is formed within said gate cavity and said matrices of fingers are disposed within said filter chamber.

3. The mold according to claim 2 wherein said fingers are tapered.

4. The mold according to claim 3 wherein said fingers on one of said side segments intervene with said fingers on said other side segment and cooperate with one another to form a gap therebetween that is the range of 0.060 to 0.080 inches wide.

5. The mold according to claim 4 wherein said fingers are arranged in parallel rows.

6. The mold according to claim 5 wherein said fingers are formed from the same material as said side segments.

7. The mold according to claim 6 wherein said fingers are formed continuously with said side segments.

8. The mold according to claim 6 wherein said fingers are formed separately from said side segments and then mounted thereupon.

9. The mold according to claim 4 wherein said fingers are mounted upon support members, said support members being removably attached to said side segments.

10. The mold according to claim 9 wherein said fingers are formed from a material that is different from the material forming said side segments.

11. The mold according to claim 10 wherein said fingers are formed from Anviloy.

12. The mold according to claim 10 wherein said fingers are formed continuously with said support members.

13. The mold according to claim 10 wherein said fingers are formed separately from said support members and then mounted thereupon.

14. The mold according to claim 4 wherein said fingers are hardened to HRC 47±2.

15. The mold according to claim 14 wherein said fingers are nitrided to increase the durability thereof.

16. The mold according to claim 3 wherein the ends of said fingers extend beyond the centerline of said filter chamber by a distance within the range of 0.1000 to 0.1500 inches.

17. The mold according to claim 16 wherein the ends of said fingers extend beyond the centerline of said filter chamber by a distance of 0.1250 inches.

* * * * *